US011898412B2

(12) United States Patent
Senger

(10) Patent No.: US 11,898,412 B2
(45) Date of Patent: Feb. 13, 2024

(54) ROD LOCK OUT CLAMP

(71) Applicant: Oil Lift Technology Inc., Calgary (CA)

(72) Inventor: Ross Willard Senger, Airdrie (CA)

(73) Assignee: Oil Lift Technology Inc., Calgary (CA)

( * ) Notice: Subject to any disclaimer, the term of this patent is extended or adjusted under 35 U.S.C. 154(b) by 0 days.

(21) Appl. No.: 17/648,569

(22) Filed: Jan. 21, 2022

(65) Prior Publication Data

US 2022/0325596 A1 Oct. 13, 2022

Related U.S. Application Data

(60) Provisional application No. 63/172,983, filed on Apr. 9, 2021.

(51) Int. Cl.

| | |
|---|---|
| ***E21B 19/10*** | (2006.01) |
| ***E21B 33/06*** | (2006.01) |
| ***E21B 33/08*** | (2006.01) |
| ***E21B 33/03*** | (2006.01) |
| *E21B 43/12* | (2006.01) |

(52) U.S. Cl.

CPC ..... *E21B 33/085* (2013.01); *E21B 19/10* (2013.01); *E21B 33/03* (2013.01); *E21B 33/062* (2013.01); *E21B 43/126* (2013.01)

(58) Field of Classification Search

CPC .. E21B 33/062; E21B 33/063; B25J 15/0033; B25J 15/0038

USPC ..... 251/1.1, 1.2, 1.3; 269/268, 270

See application file for complete search history.

(56) References Cited

U.S. PATENT DOCUMENTS

| | | | | |
|---|---|---|---|---|
| 2,238,742 | A * | 4/1941 | Laurent | E21B 33/03 403/3 |
| 2,699,601 | A * | 1/1955 | Darnell | F16L 3/1218 248/231.71 |
| 6,354,568 | B1 * | 3/2002 | Carruthers | F16K 3/314 251/328 |
| 9,322,238 | B2 | 4/2016 | Hult | |
| 2012/0043083 | A1 * | 2/2012 | Jahnke | E21B 33/063 166/55.1 |
| 2012/0067563 | A1 * | 3/2012 | Jellison | E21B 17/042 427/205 |
| 2022/0213757 | A1 * | 7/2022 | Threadgill | E21B 33/063 |

* cited by examiner

*Primary Examiner* — Robert E Fuller

(74) *Attorney, Agent, or Firm* — McDonnell Boehnen Hulbert & Berghoff LLP

(57) ABSTRACT

A rod lock out clamp includes a housing having a central bore for receiving a rod in spaced relation therethrough and clamp members in the housing for grippingly and frictionally engaging the rod in the bore. At least one of the clamp members has an inner end and a recess in the inner end, the recess having a profile with an arcuate portion having a radius of curvature that reduces from a maximum radius to a minimum radius. Manipulating means are coupled to the housing and the clamp members for moving the clamp members between a rod gripping position and a retracted position.

26 Claims, 7 Drawing Sheets

ROD LOCK OUT CLAMP

CROSS-REFERENCE TO RELATED APPLICATIONS

The present application is a Non-Provisional Patent Application claiming priority to U.S. Provisional Patent Application No. 63/172,983, filed Apr. 9, 2021, the contents of which are hereby incorporated by reference.

FIELD OF THE DISCLOSURE

This application relates generally to a rod lock out clamp for use on a well bore in a production oil, water or gas well installation.

BACKGROUND

In some production oil, water or gas well installations, a so-called polished rod is part of the rod string that extends down into the well installation. The polished rod rotates the sucker rods further down the string and allows for dynamic sealing with the drive head at the top of the installation.

A polished rod lock out clamp is used to grippingly engage the polished rod and suspend the rod string during servicing of the installation, such as, conducting stuffing box and rod rotator changeouts.

In some installations, a lock out clamp may grip directly onto a continuous rod in the rod string or onto a polished rod connected to the continuous rod rather than directly to the sucker rods.

The rod being gripped by the lock out clamp extends through a bore in the clamp and one or more clamping members may be advanced into the bore to frictionally and grippingly engage the rod. The lock out clamp may be integrated into a drive head of the production well or may be provided as a separate assembly, which is secured to and between the drive head and a flow tee. Embodiments of a rod lock out clamp are described, for example, in U.S. Pat. No. 9,322,238, which is hereby incorporated herein in its entirety.

SUMMARY

According to some embodiments of the present disclosure, there is provided a rod lock out clamp for use on a well bore in a production oil, water or gas well installation, the lock out clamp comprising: a housing having a central bore for receiving a rod in spaced relation therethrough; clamp members in the housing for grippingly and frictionally engaging the rod in the bore, at least one of the clamp members having an inner end and a recess in the inner end, the recess having a profile with an arcuate portion having a radius of curvature that reduces from a maximum radius to a minimum radius; and manipulating means coupled to the housing and the clamp members for moving the clamp members between a rod gripping position in which the clamp members grippingly engaged the rod to prevent rotation or axial movement thereof, and a retracted position in which the clamp members are removed from the rod to permit rotational and axial movement of the rod in the bore.

According to some embodiments of the present disclosure, there is provided a clamp member for use in clamping a rod, the clamp member comprising: a body having a recess for receiving the rod, the recess having a profile with an arcuate portion having a radius of curvature that reduces from a maximum radius to a minimum radius, a coupling portion configured for coupling to manipulating means for advancing the clamp member towards the rod to be clamped.

BRIEF DESCRIPTION OF THE FIGURES

The foregoing summary, as well as the following detailed description of illustrative embodiments of the present application, will be better understood when read in conjunction with the appended drawings. For the purposes of illustrating the present application, there is shown in the drawings illustrative embodiments of the disclosure. It should be understood, however, that the application is not limited to the precise arrangements and instrumentalities shown. In the drawings.

DETAILED DESCRIPTION

Figure 1:
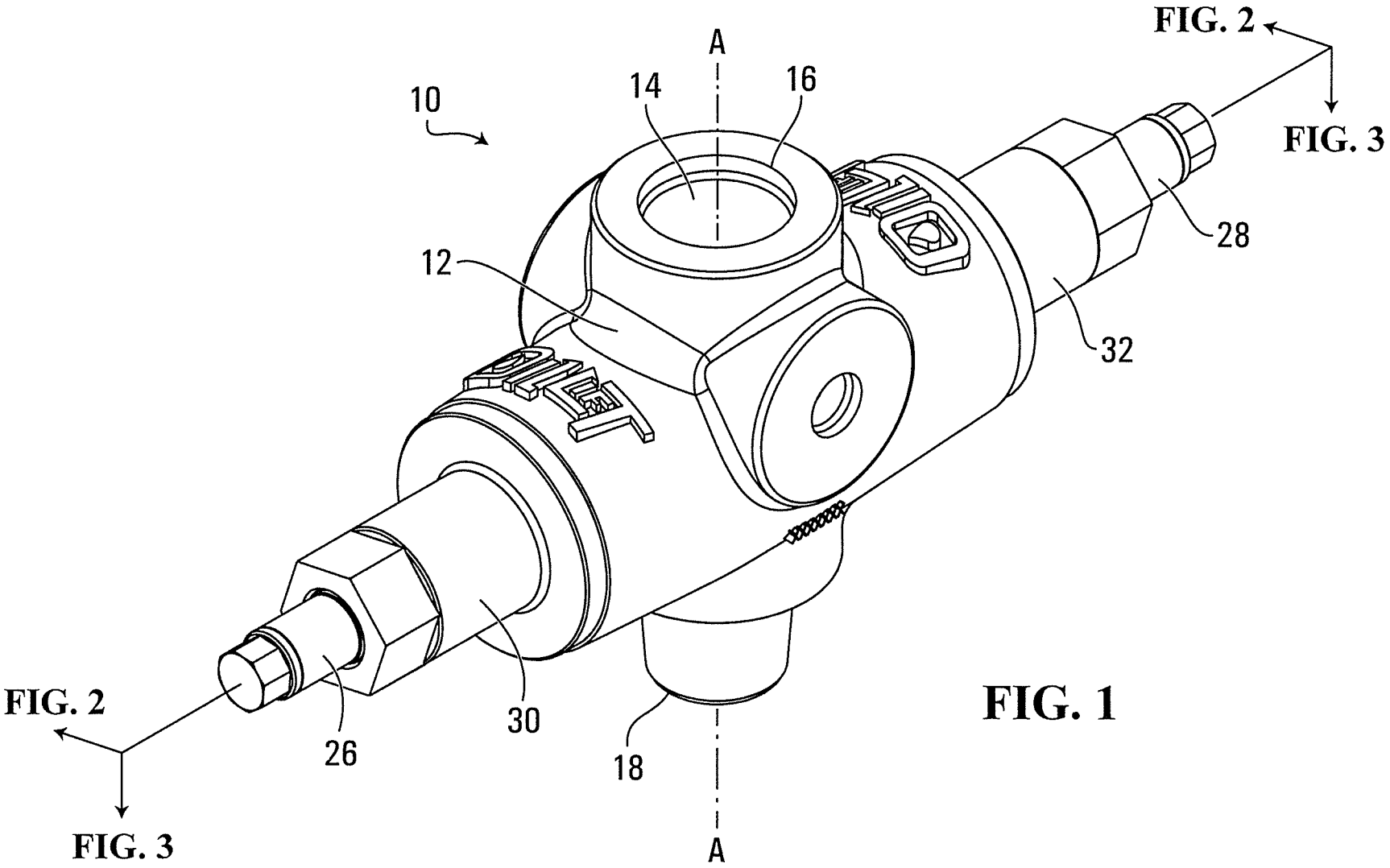
FIG. 1 is a perspective view of a rod lock out clamp according to embodiments of the present disclosure.
Figure 2:
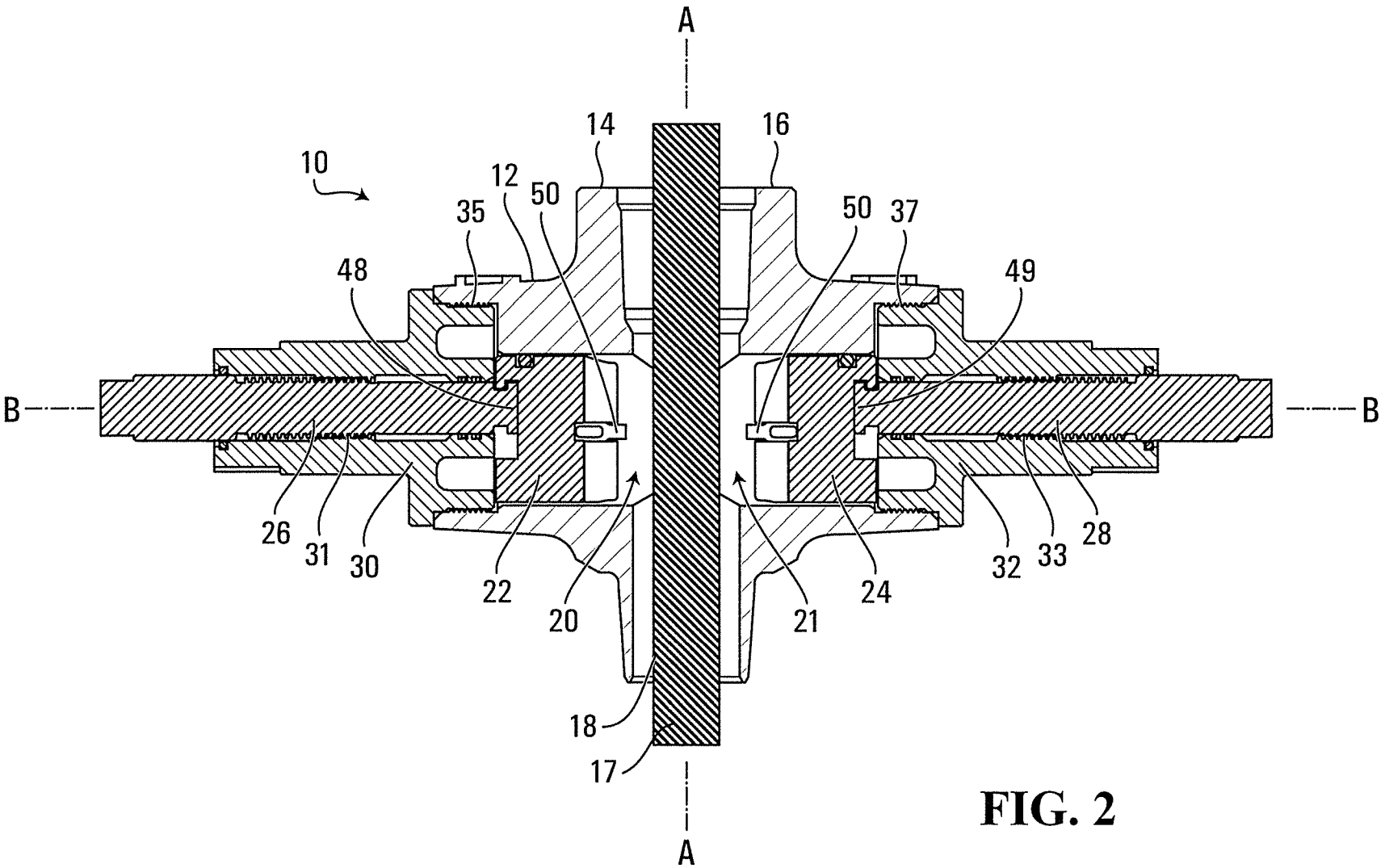
FIG. 2 is a cross-sectional view of the rod lock out clamp taken along line 2-2 in FIG. 1.
Figure 3:
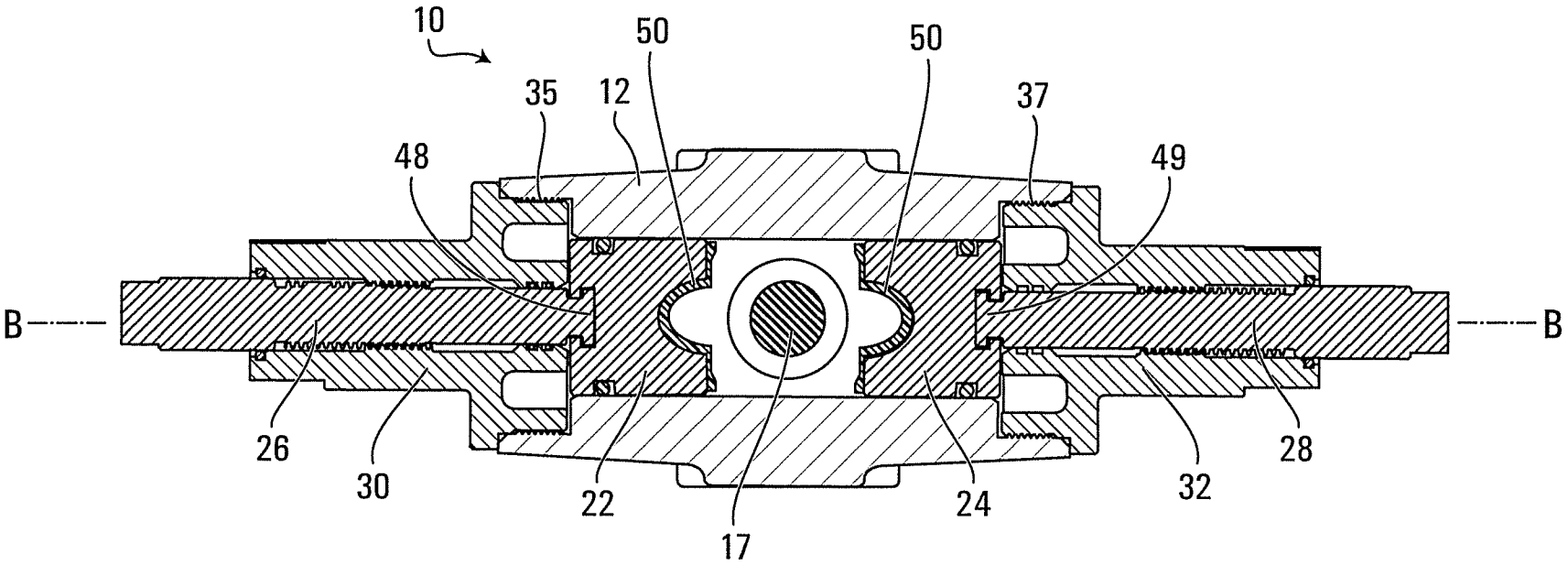
FIG. 3 is a cross-sectional view of the rod lock out clamp taken along line 3-3 in FIG. 1.

Referring to FIGS. 1 to 3, embodiments of a rod lock out clamp 10 will be described. The lock out clamp 10 includes a housing 12, having a vertical, central bore 14, extending from an upper opening 16 to a lower opening 18. The central bore 14 receives a rod 17, such as a polished rod (shown in cross-section in FIGS. 2 and 3) in annularly spaced relation therethrough. While embodiments herein will be described with respect to a polished rod, as noted above, the rod lock out clamp 10 may be used with other rods as well.

Horizontal, radially opposed piston bores 20, 21 extend transversely to and intersect the central bore 14 such that the central axes A and B of the central bore 14 and piston bores 20, 21 intersect at a right angle. Positioned within the piston bores 20, 21 are radially opposed left and right rams 22, 24 that are equally angularly spaced about the axis A of the central bore 14 and the rod 17. The left and right rams 22, 24 are coupled to respective left and right manipulating means, which, in the illustrated embodiment, are embodied as clamp bolts 26, 28. Each of the clamp bolts 26, 28 are threadingly coupled to respective left and right end caps 30, 32, along threads 31, 33, respectively. The end caps 30, 32 are in turn coupled to the housing 12 along threads 35, 37, respectively. In other embodiments, the end caps may be bolted to the housing. Other embodiments are also possible.

Figure 4:
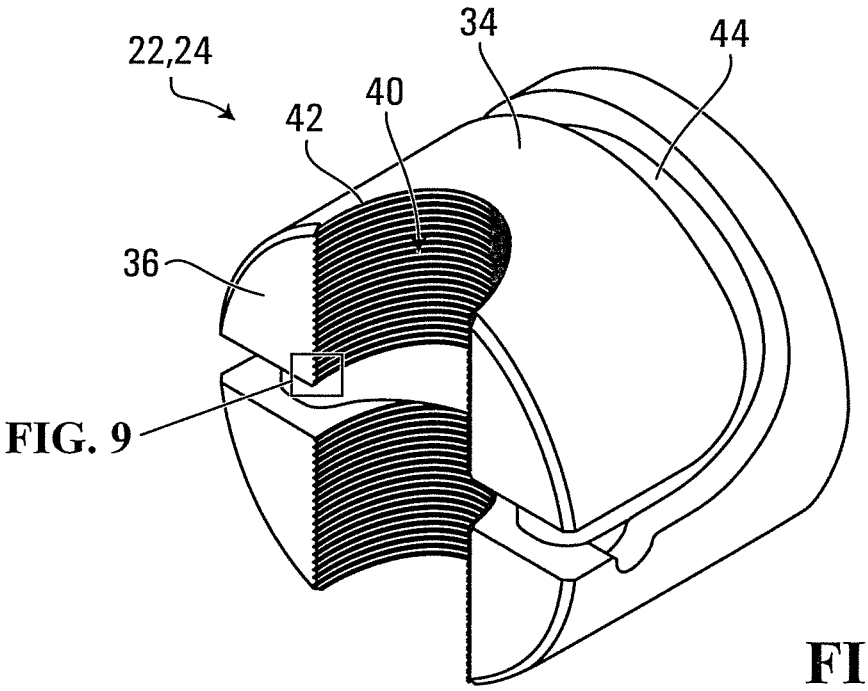
FIG. 4 is a first perspective view of a ram of the rod lock out clamp of FIG. 1.
Figure 5:
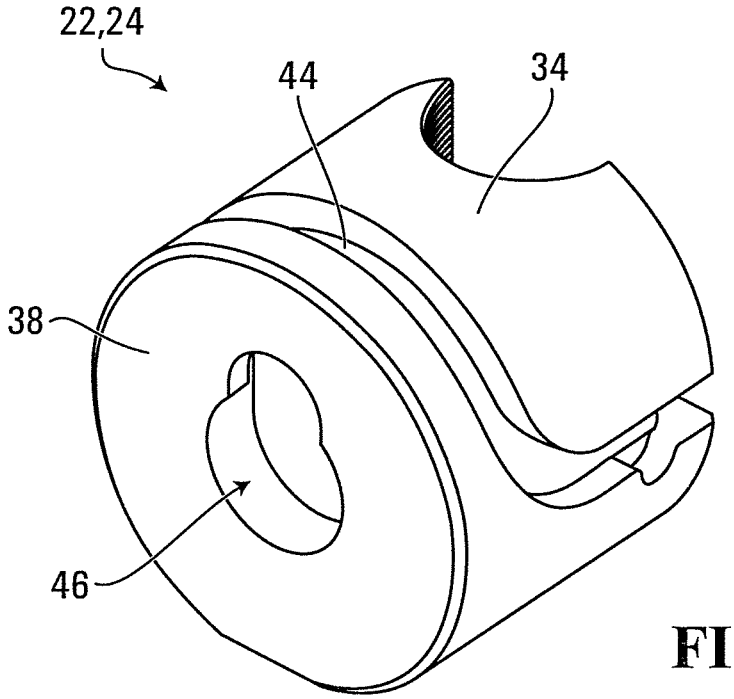
FIG. 5 is a second perspective view thereof.
Figure 6:
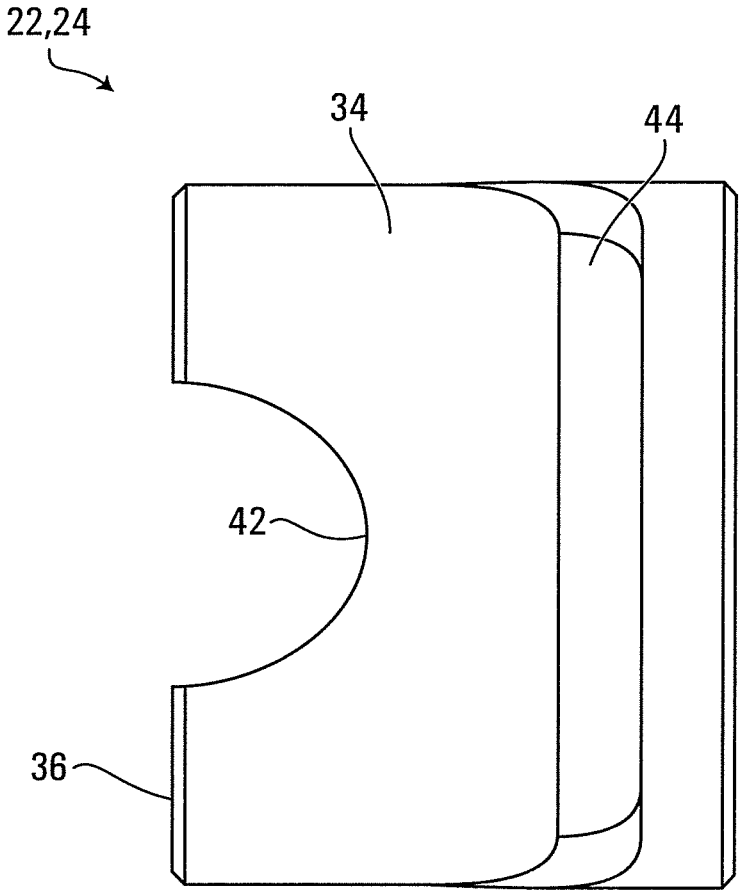
FIG. 6 is a top view thereof.

Referring to FIGS. 4 to 6, the rams 22, 24 will now be described in more detail. In the illustrated embodiment, the left and right rams 22, 24 are substantially identical, having equivalent features. Each of the rams 22, 24 comprises a body 34 generally in the shape of a cylinder. The body 34 includes an inner end or face 36 and an outer end or face 38. The inner end 36 includes an arcuate recess 40, which has a profile 42 as seen from the top or bottom planar view. Each of the rams 22, 24 further includes groove 44, which extends continuously along an upper side of the body 34, along both sides of the body 34, and across the inner end 36, including within recess 40.

On the outer end 38, the ram 22 includes a key slot 46 for receiving respective T-shaped heads 48, 49 of the left and right clamp bolts 26, 28 and thereby coupling the rams 22, 24 to the clamp bolts 26, 28. This coupling permits rotation of the clamp bolts 26, 28 to advance or retract the rams 22, 24, depending on the direction of rotation of the clamp bolts 26, 28. Thus, the rams 22, 24 may be advanced into a gripping position in which they make contact with and grippingly engage the rod 17, as further described below.

In the illustrated embodiments, the rams 22, 24 may be retracted out of the central bore 14 so as not to restrict the diameter through the central bore 14 in the event sucker rods within the well installation may need to be pulled through the rod lock out clamp 10.

Moreover, unlike known configurations in which ram blocks are typically only used for clamping or only for sealing, according to some embodiments of the present disclosure, the clamping means, e.g. rams 22, 24, may also function to allow clamp 10 to act as a blow out preventer (BOP) and seal against the clamped rod. BOPs may form a seal around the rod 17 to prevent well fluids from escaping the well. The sealing function is accomplished by providing a seal 50, which is positioned within the groove 44 and therefore runs across the inner end of the ram 22, along the recess 40, along the mid height of the ram 22 and then circumferentially around the ram 22. When the rams 22, 24 are advanced into the closed or gripping position, the seal 50 seals between the rams 22, 24, between the rams 22, 24 and the rod 17 and between the rams 22, 24 and their respective piston bores 20, 21. Thus, well fluid is prevented from coming up the well bore and escaping while the well is being serviced. In the illustrated embodiment, the seal 50 is made of an elastomer. Other seal arrangements are also possible, including thermal plastic and packing material, such as graphite or Teflon™ fabric.

Other embodiments of the rams 22, 24 are also possible. For example, the body of the rams may not be cylindrical or may have a different configuration sized and dimensioned to be positioned within their respective piston bores. In embodiments, where the clamp members are not positioned within a piston bore but in, for example, the central bore, the clamp members may have an extruded shape sized and dimensioned to be positioned within the central bore such that the recess extends generally parallel to the rod.

In some embodiments, the rams may comprise two pieces. In such embodiments, the transmission of force through the seal material to the grip face would actuate the seal material.

Figure 7:
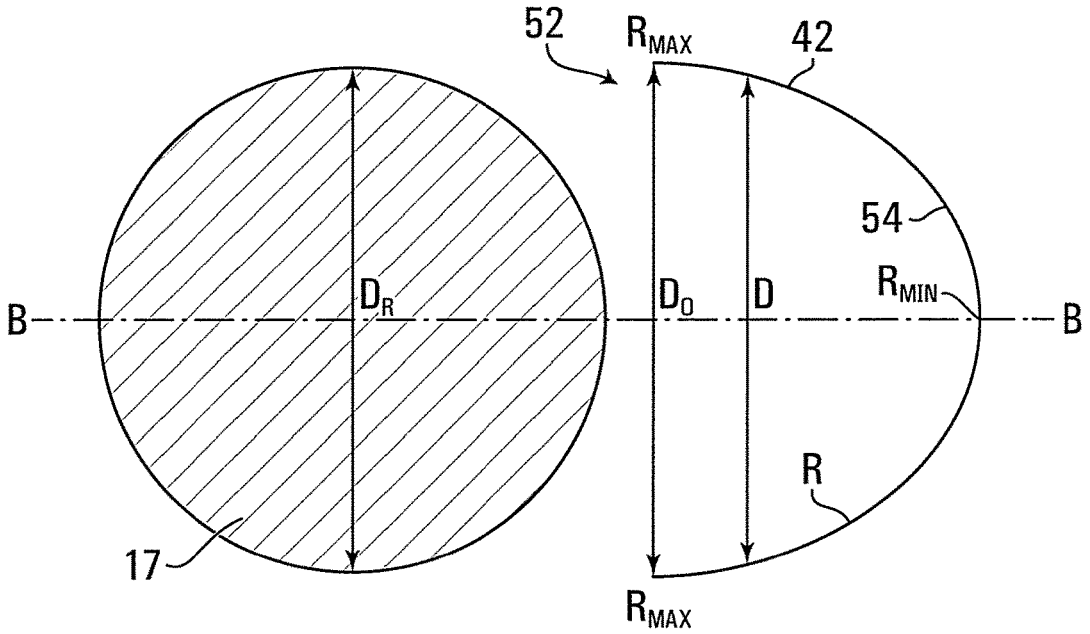
FIG. 7 is a schematic view of a profile of the ram of FIG. 4.
Figure 8:
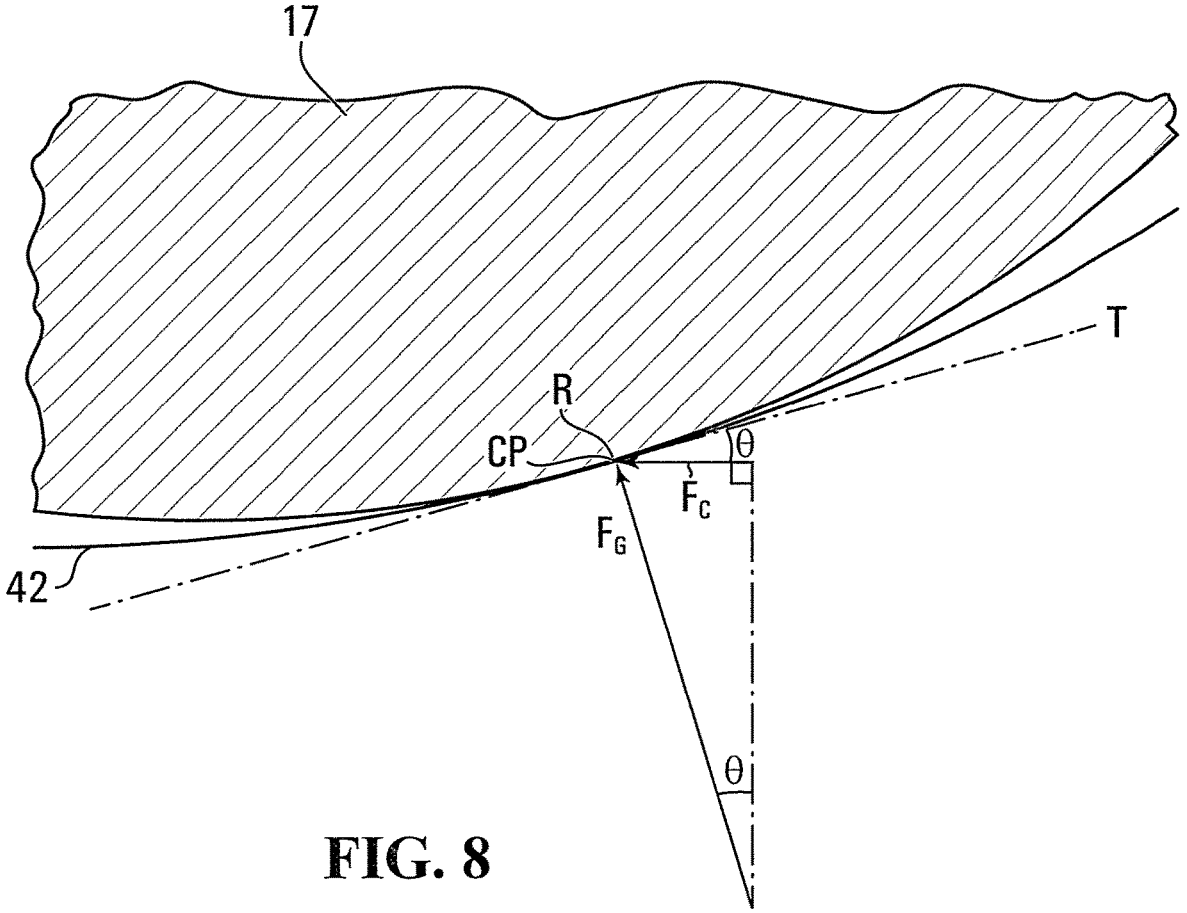
FIG. 8 is a schematic view of a portion of the profile of FIG. 7 contacting the polished rod.

Referring to FIGS. 7 and 8, the profile 42 of the rams 22, 24 will be discussed in greater detail. The profile 42 includes an inner opening 52 and an inner surface 54. The inner opening 52 has a distance $D_O$, sized larger than the diameter $D_R$ of the rod 17. A radius of curvature R of the inner surface 54 varies along an arcuate portion of the profile 42 and is not constant. The radius of curvature R has a maximum, $R_{MAX}$. In the illustrated embodiment, the arcuate portion makes up an entire half of the profile, which is symmetrical about axis B. The arcuate portion begins at the inner opening 52. Thus, $R_{MAX}$ is at the inner opening 52 and decreases continuously to a minimum radius of curvature, $R_{MIN}$. In the illustrated embodiment, $R_{MIN}$, is positioned at a halfway point between opposing sides of the profile 42.

Due to the decreasing radius of curvature, the horizontal distance D across the profile 42 decreases from the opening 52 and becomes smaller than the diameter $D_R$ of the rod, resulting in contact between the profile 42 and the rod as each of the rams 22, 24 is advanced to engage the rod 17.

A contact angle Θ may be defined between a tangent T to the profile 42 at the contact point CP with the rod 17 and the direction of advancement of each ram 22, 24, i.e. the direction in which a clamping force $F_C$ of each ram 22, 24 is applied. The actual gripping force $F_G$ applied by the profile 42 onto the rod at the contact point is normal to the tangent and equates to $F_G=F_C/\sin(\Theta)$, resulting in a force multiplication of the gripping force $F_G$ as compared to the clamping force $F_C$ for contact angles Θ of less than 90 degrees.

The smaller the contact angle Θ, the larger the force multiplier will be. The following table outlines some example force multipliers:

| Contact Angle Θ | Force multiplier |
|---|---|
| 20° | 2.92 |
| 15° | 3.86 |
| 10° | 5.76 |
| 5° | 11.47 |
| 2.5° | 22.93 |

Moreover, it will be appreciated that the contact angle Θ is itself a function of the radius of curvature R of the profile 42. As such, the actual gripping force $F_G$ varies as a function of the radius of curvature R of the arcuate portion of the profile 42.

The rod lock out clamp 10 may be used on installations with different rod diameters. The location of the contact point CP along the profile 42, and thus the contact angle Θ, depends on the diameter of the rod $D_R$, which determines where the rod 17 contacts the profile 42. Thus, the gripping force $F_G$ applied to the rod also depends on the diameter $D_R$ of the rod 17. The profile 42 may be configured to ensure a sufficient gripping force $F_G$ for a range of intended rod diameters. The varying radius of curvature of the profile 42 may also be configured to ensure that the maximum gripping force $F_G$ applied to the rod 17 is within the elastic regime of both the rod and recess 40 to avoid plastic deformation of either.

Other embodiments of the profile are possible. In some embodiments, the maximum radius of curvature $R_{MAX}$ may not be at the inner opening 52 and instead the profile 42 may have a fixed width or tapering portion from the inner opening 52 until the reducing radius arcuate portion of the profile 42 that begins with $R_{MAX}$. The fixed width or tapering portion would be sufficiently large to permit the rod to enter the recess 44.

Alternatively, or in addition, the minimum radius of curvature $R_{MIN}$ may not be at a halfway point, while the profile 42 would still be symmetrical. Thus, on opposing sides of the profile 42 about the centre line, the radius of curvature may decrease to a minimum before the halfway point, followed by a non-continuous change in the radius of curvature, a tapering portion, a flat section or any other suitable geometry to complete and connect the opposing sides of the profile 42. More generally, the arcuate portion of the profile 42 may be less than the entire profile. The profile 42 may be sized and dimensioned so that the intended diameters of the rod contact only on the arcuate portion with a reducing radius of curvature.

In some embodiments, the radius of curvature may not decrease continuously but may decrease step-wise or be a combination of step-wise and continuous decreases. In some embodiments, the profile matches that of a portion of an ellipse. More generally, the profile may include a portion of a simple curve.

Figure 9:
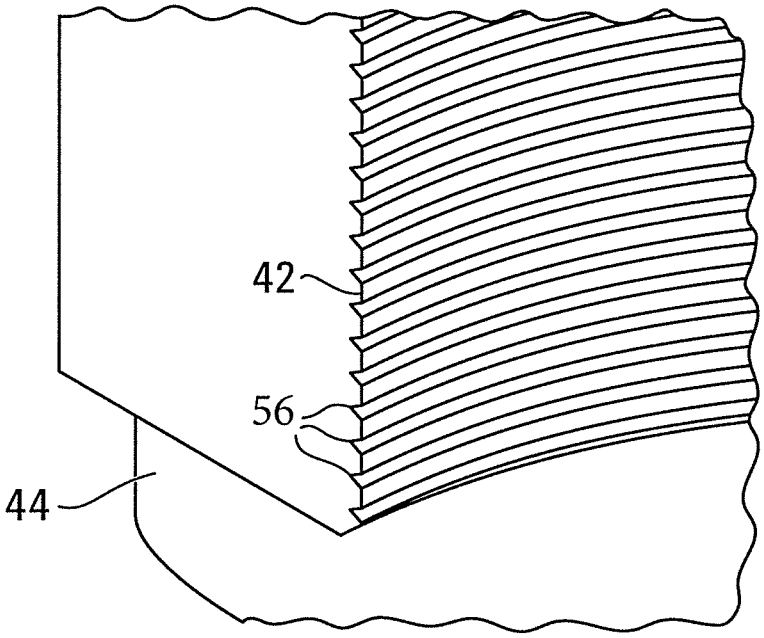
FIG. 9 is an enlarged view of the portion identified in FIG. 4.

Referring to FIG. 9, in the illustrated embodiment, the profile 42 includes a series of parallel, V-shaped notches 56 in the inner face 54 extending horizontally across and following the contour of the inner face 54 and thus profile 42. The notches 56 may allow for elastic deformation of the inner face 54 due to the compression resulting from the gripping force FG when the rod 17 is clamped. The notches 56 may also provide a path for contaminants, such as oil, grease or produced fluid, to escape the ram to rod contact surface. This may improve the grip of the clamp members and improve the functioning of the rod lock out clamp 10.

Other embodiments are also possible. For example, in other embodiments, the notches 56 may have a different cross-sectional shape, be wider or narrower, be further or closer apart, extend over less than all of the inner face 54 and/or may extend in directions other than horizontal. In some embodiments, not all notches 56 are configured the same. In some embodiments, the notches may be omitted entirely.

The principles and embodiments of the ram profile discussed herein may be incorporated into other rod lock out clamps that vary from the illustrated embodiment. For example, more than two rams may be provided with one or more having a profile as disclosed herein. Other manipulating means may be used to advance the rams, such as pistons. The rams may be positioned in a different part of the housing, such as within the central bore and not in a separate clamping bore. The rams are not necessarily in the same plane. The rams could be offset by a distance of as much as a ram block height.

More generally, any clamp members intended to clamp a rod may incorporate part or all of a profile as disclosed and taught herein.

Numerous specific details have been set forth in order to provide a more thorough understanding of the inventive concepts. However, it will be apparent to one of ordinary skill in the art that the inventive concepts within the instant disclosure may be practiced without these specific details. In other instances, well-known features have not been described in detail to avoid unnecessarily complicating the instant disclosure.

As used herein, the terms "comprises," "comprising," "includes," "including," "has," "having" or any other variation thereof, are intended to cover a nonexclusive inclusion. For example, a composition, a process, method, article, or apparatus that comprises a list of elements is not necessarily limited to only those elements but may include other elements not expressly listed or inherently present therein.

As used herein the terms "approximately," "about," "substantially" and variations thereof are intended to include not only the exact value qualified by the term, but to also include some slight deviations therefrom, such as deviations caused by measuring error, manufacturing tolerances, wear and tear on components or structures, stress exerted on structures, and combinations thereof, for example.

Use of the "a" or "an" are employed to describe elements and components of the embodiments herein. This is done merely for convenience and to give a general sense of the inventive concepts. This description should be read to include one or at least one and the singular also includes the plural unless it is obvious that it is meant otherwise.

Any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment. Moreover, it will be understood that features of one embodiment may be combined with features of other embodiments, even if not expressly recited or described as a combination.

What is claimed is:

1. A rod lock out clamp for use on a well bore in a production oil, water or gas well installation, the lock out clamp comprising:

a housing having a central bore for receiving a rod in spaced relation therethrough;

clamp members in the housing for grippingly and frictionally engaging the rod in the bore, at least one of the clamp members having an inner end and a recess in the inner end, the recess having a profile with an arcuate portion having a radius of curvature that reduces from a maximum radius to a minimum radius, wherein the at least one clamp member comprises a generally cylindrical body; and manipulating means coupled to the housing and the clamp members for moving the clamp members between a rod gripping position in which the clamp members grippingly engage the rod to prevent rotation or axial movement thereof, and a retracted position in which the clamp members are removed from the rod to permit rotational and axial movement of the rod in the bore.

2. The lock out clamp of claim 1, wherein the arcuate portion extends from an opening of the recess such that the maximum radius is at the opening.

3. The lock out clamp of claim 1, wherein the minimum radius is at a halfway point between two ends of the profile.

4. The lock out clamp of claim 1, wherein a width of an opening of the recess is equal to or larger than a diameter of the rod.

5. The lock out clamp of claim 1, wherein the radius of curvature reduces continuously, step-wise, or a combination of step-wise and continuously from the maximum radius to the minimum radius.

6. The lock out clamp of claim 1, wherein the arcuate portion of the profile is a portion of an ellipse.

7. The lock out clamp of claim 1, wherein the radius of curvature of the arcuate portion is configured to result in a range of gripping forces that are within the elastic regimes of the rod and the at least one clamp member.

8. The lock out clamp of claim 1, wherein each of the clamp members incorporates a sealing material for sealing the clamp members to each other and to the rod.

9. The lock out clamp of claim 8, wherein the sealing material is positioned within a groove that runs at least across the recess.

10. The lock out clamp of claim 1, wherein the clamp member is comprised of two or more pieces.

11. The lock out clamp of claim 1, wherein the recess includes an inner surface, the inner surface having a plurality of parallel notches.

12. The lock out clamp of claim 1, wherein the clamp members comprise two radially opposed rams, the rams having mutually engageable end faces at the inner ends thereof and elastomeric seal means disposed between the end faces, the rams being sealingly disposed in a respective clamping bore and being sealingly engageable with the rod and with each other to prevent well fluids from escaping past the lock out clamp when the clamp members are disposed in the gripping position.

13. A rod lock out clamp for use on a well bore in a production oil, water or gas well installation, the lock out clamp comprising:

a housing having a central bore for receiving a rod in spaced relation therethrough;

clamp members in the housing for grippingly and frictionally engaging the rod in the bore, at least one of the clamp members having an inner end and a recess in the inner end, the recess having a profile with an arcuate portion having a radius of curvature that reduces from a maximum radius to a minimum radius; and manipulating means coupled to the housing and the clamp members for moving the clamp members between a rod gripping position in which the clamp members grippingly engaged the rod to prevent rotation or axial movement thereof, and a retracted position in which the clamp members are removed from the rod to permit rotational and axial movement of the rod in the bore, wherein the recess includes an inner surface, the inner surface having a plurality of parallel notches.

14. A rod lock out clamp for use on a well bore in a production oil, water or gas well installation, the lock out clamp comprising:

a housing having a central bore for receiving a rod in spaced relation therethrough;

clamp members in the housing for grippingly and frictionally engaging the rod in the bore, at least one of the clamp members having an inner end and a recess in the inner end, the recess having a profile with an arcuate portion having a radius of curvature that reduces from a maximum radius to a minimum radius; and manipulating means coupled to the housing and the clamp members for moving the clamp members between a rod gripping position in which the clamp members grippingly engaged the rod to prevent rotation or axial movement thereof, and a retracted position in which the clamp members are removed from the rod to permit rotational and axial movement of the rod in the bore, wherein the clamp members comprise two radially opposed rams, the rams having mutually engageable end faces at the inner ends thereof and elastomeric seal means disposed between the end faces, the rams being sealingly disposed in a respective clamping bore and being sealingly engageable with the rod and with each other to prevent well fluids from escaping past the lock out clamp when the clamp members are disposed in the gripping position.

15. A clamp member for use in clamping a rod, the clamp member comprising:

a body having a recess for receiving the rod, the recess having a profile with an arcuate portion having a radius of curvature that reduces from a maximum radius to a minimum radius, wherein the minimum radius is at a halfway point between two ends of the profile, and wherein the body is generally cylindrical and has a first end and a second end, the recess being positioned within the first end; and a coupling portion configured for coupling to manipulating means for advancing the clamp member towards the rod to be clamped.

16. The clamp member of claim 15, wherein the arcuate portion extends from an opening of the recess such that the maximum radius is at the opening.

17. The clamp member of claim 15, wherein a width of an opening of the recess is larger than a diameter of the rod to be clamped.

18. The clamp member of claim 15, wherein the radius of curvature reduces continuously, step-wise, or a combination of step-wise and continuously from the maximum radius to the minimum radius.

19. The clamp member of claim 15, wherein the radius of curvature of the arcuate portion is configured to result in a range of gripping forces that are within the elastic regimes of the rod to be clamped and the clamp member.

20. The clamp member of claim 15, wherein the recess includes an inner surface, the inner surface having a plurality of parallel notches.

21. The clamp member of claim 15, wherein the body includes a sealing groove for receiving elastomeric sealing means, the sealing groove extending across the profile.

22. The clamp member of claim 15, wherein the clamp member comprises a groove for incorporating a sealing material for sealing the clamp member to another clamp member and the rod.

23. The clamp member of claim 22, wherein the groove runs at least across the recess.

24. The clamp member of claim 15, wherein the recess includes an inner surface, the inner surface having a plurality of parallel notches.

25. The clamp member of claim 15, wherein the clamp member is comprised of two or more pieces.

26. A clamp member for use in a clamping rod, the clamp member comprising:

a body having a recess for receiving the rod, the recess having a profile with an arcuate portion having a radius of curvature that reduces from a maximum radius to a minimum radius, wherein the arcuate portion of the profile is a portion of an ellipse, and wherein the body is generally cylindrical and has a first end and a second end, the recess being positioned within the first end, and a coupling portion configured for coupling to manipulating means for advancing the clamp member towards the rod to be clamped.

* * * * *